US005131653A

United States Patent [19]

Yu

[11] Patent Number: 5,131,653

[45] Date of Patent: Jul. 21, 1992

[54] RACKET FOR PLAY AND SPORTS

[76] Inventor: Chien-Ping Yu, No. 13, Lane 85, Tungyang Rd., Fengyuan, Taichung Hsien, Taiwan

[21] Appl. No.: 746,858

[22] Filed: Aug. 19, 1991

[51] Int. Cl.[5] ..... A63B 49/00; A63B 51/04

[52] U.S. Cl. ..... 273/73 R; 273/73 L

[58] Field of Search ..... 273/73 R, 73 C, 73 D, 273/73 E, 73 L

[56] References Cited

U.S. PATENT DOCUMENTS 3,048,399 8/1962 Breitbach ..... 273/73 R
3,734,499 5/1973 Goldstein ..... 273/23 R X
4,274,634 6/1981 Berlutti ..... 273/73 L

FOREIGN PATENT DOCUMENTS 204113 9/1923 United Kingdom ..... 273/73 L
2126614 3/1984 United Kingdom ..... 273/73 R
2150444 7/1985 United Kingdom ..... 273/73 R

*Primary Examiner*—Paul E. Shapiro
*Assistant Examiner*—Raleigh W. Chiu
*Attorney, Agent, or Firm*—Merchant, Gould, Smith, Edell, Welter & Schmidt

[57] ABSTRACT

A racket including a pair of frames engageable with each other and each having a head portion and a handle portion, a recess formed in each of the head portions so as to form a ring-shaped space when the frames are engaged with each other, a body engageable in the ring-shaped space, a flange extended inward from an inner periphery of the body and formed integral with the body, and a network of strings having a periphery fixed to the flange of the body so as to form a ball striking surface.

2 Claims, 4 Drawing Sheets

RACKET FOR PLAY AND SPORTS

BACKGROUND OF THE INVENTION

1. Field of the Invention

The present invention relates to a racket, and more particularly to a racket for play and sports.

2. Description of the Prior Art

Typical rackets include tennis racket, badminton racket and squash racket. Each of the rackets includes a racket frame having an approximately oval-shaped or ovaloid head portion defining a ball striking surface, such as the network of strings, and a handle or shaft portion ending with a grip portion. The strings should be threaded through a plurality of holes formed in the periphery of the head portion so that the threading operations can not be carried out in a fast speed. The threading operations are very inconvenient.

The present invention has arisen to provide a novel racket for play and sports.

SUMMARY OF THE INVENTION

The primary objective of the present invention is to provide a racket in which the strings are preformed as a network and can be disposed in place without any threading operations.

In accordance with one aspect of the invention, there is provided a racket including a pair of frames engageable with each other and each having a head portion and a handle portion, a recess formed in each of the head portions so as to form a ring-shaped space when the frames are engaged with each other, a body engageable in the ring-shaped space, a flange extended inward from an inner periphery of the body and formed integral with the body, and a network of strings having a periphery fixed to the flange of the body so as to form a ball striking surface.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
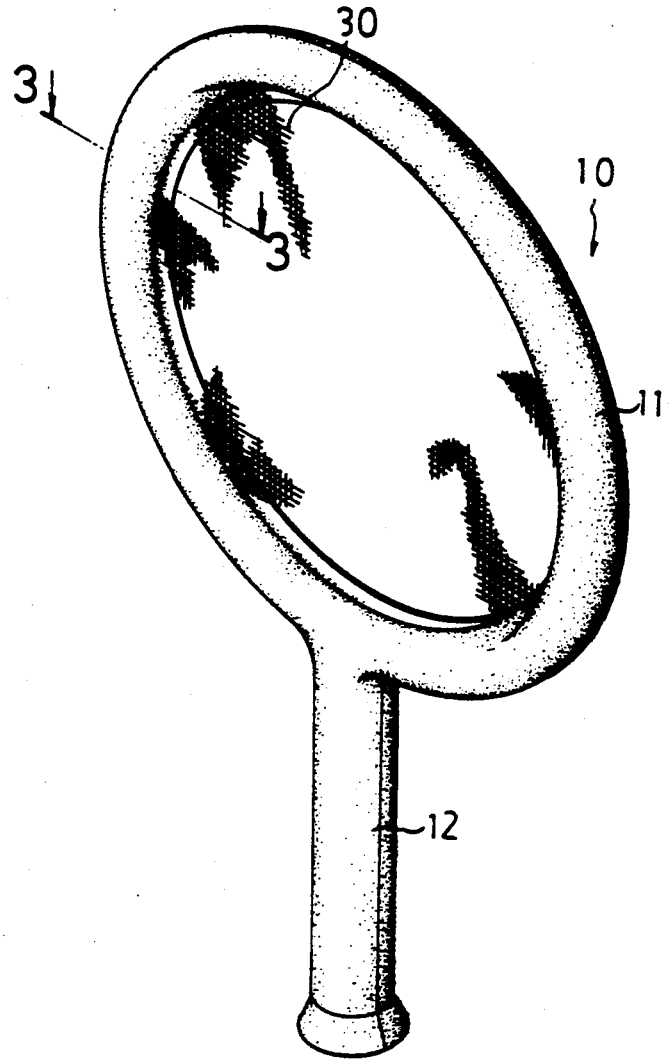
FIG. 1 is a perspective view of a racket in accordance with the present invention.
Figure 2:
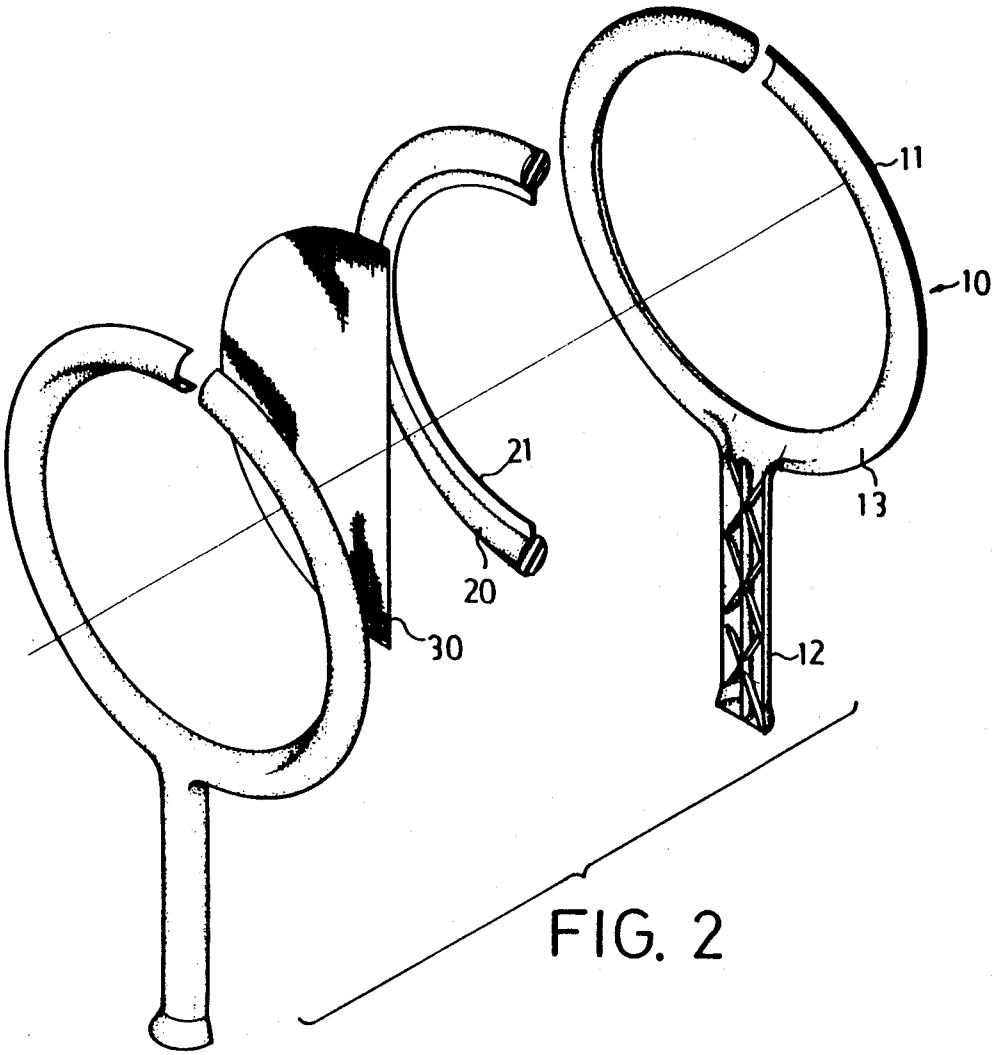
FIG. 2 is an exploded view of the racket.
Figure 3:
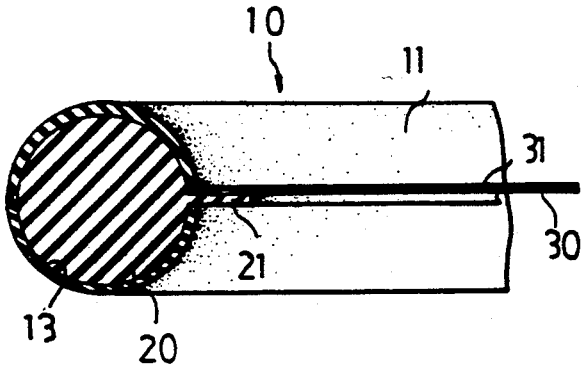
FIG. 3 is a cross sectional view taken along lines 3—3 of FIG. 1.

Referring to the drawings and initially to FIGS. 1, 2 and 3, a racket in accordance with the present invention comprises generally a pair of frames 10 each including a head portion 11 and a handle portion 12 integrally formed together; a body 20 engaged between the head portions 11 of the frames 10; and a network of strings 30 fixed in the inner portion of the body 20 so as to define a ball striking surface.

The frames 10 is preferably made of plastic materials so that the frames 10, when abutted with each other, can be welded together by such as ultrasonic welding or high frequency heating processes. The head portion 11 can either be oval-shaped or circular-shaped having a recess 13 formed therearound. The recesses 13 of the head portions II form a ring-shaped space, such as circular or oval shaped space, when the frames 10 are welded together. The body 20 has a shape corresponding to the shape of the head portions II so that the body can be received in the circular or oval shaped space formed by the recesses 13 of the head portions 11. A flange 2I extends inward of the body 20 from the inner periphery thereof and extends outward beyond the head portions II when the frames 10 are fixed together, best shown in FIG. 3. The outer periphery of the network 30 is welded to the flange 21 by such as ultrasonic welding or high frequency heating processes.

Figure 4:
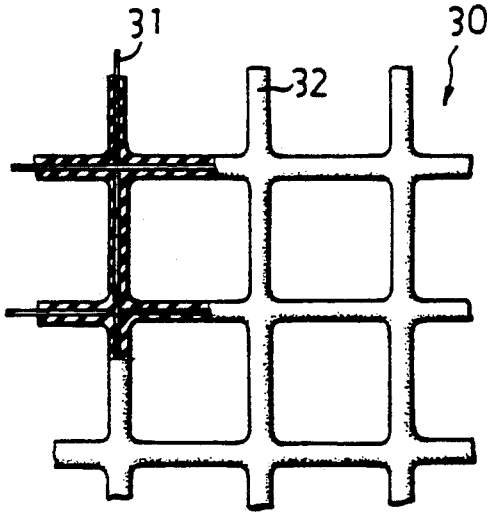
FIG. 4 is a schematic view illustrating the configuration of the network of strings.

Referring next to FIG. 4, the network 30 includes a plurality of strings 31 arranged in network shape. The strings 31 are covered with a coating 32 which is preferably made of polyvinyl chloride (PVC) so that the periphery of the network 30 can be welded to the flange by such as high frequency heating processes.

Figure 5:
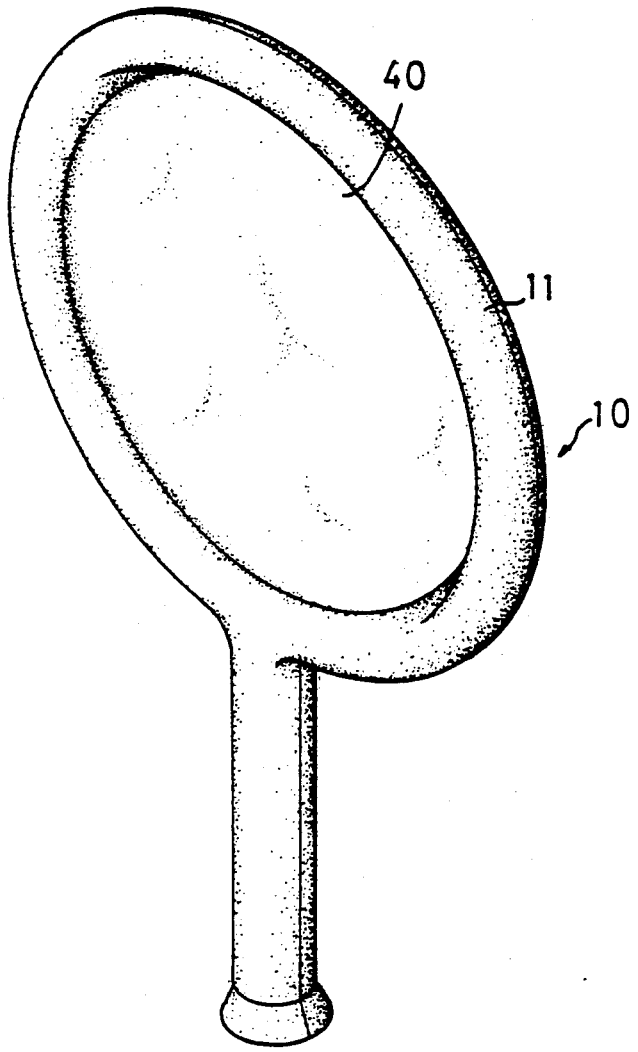
FIG. 5 is a perspective view of a racket in accordance with a second embodiment of the invention.

Referring next to FIG. 5, illustrated is a racket in accordance with a second embodiment of the present invention. Instead of the network of strings 30 as disclosed in the previous embodiment, a resilient fabric 40 has a periphery fixed to the flange 21 of the body 20. One type of the resilient fabric 40 is the fabric for making swimsuit which has high resilience.

Accordingly, the network of strings 30 or the resilient fabric 40 of the racket can be easily fixed to the body 20 without any threading processes. The racket in accordance with the present invention can be used for striking any kind of balls which have light weight, such as tennis balls, balls for squash etc.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A racket said comprising a pair of frames engageable with each other, each of said frames including a head portion and a handle portion formed integral with each other, each of said head portions having a recess formed therealong, said recesses of said head portions forming a ring-shaped space when said frames are engaged with each other, a ring-shaped body engageable in said ring-shaped space formed by said head portions of said frmes and including a flange extended inward from an inner peripheral portion thereof, said flange being formed integral with said body, and a network having a periphery fixed to said flange s that said network cn be fixed in place and so as to form a ball sriking surface.

2. A racket comprising a pair of frames engageable with each other, each of said frames including a head portion and a handle portion formed integral with each other, each of said head portions having a recess formed therealong, said recesses of said head portions forming a ring-shaped space when said frames are engaged with each other, a body shaped space when said frames are engaged with each other, a body engageable in said ring-shaped space formed by said head portions of said frames, a flange extended inward from an inner peripheral portion of said body and formed integral with said body, and a fabric having a periphery fixed to said flange of said body so as form a ball striking surface.

* * * * *